US012172068B2

(12) United States Patent
Amanna

(10) Patent No.: US 12,172,068 B2
(45) Date of Patent: Dec. 24, 2024

(54) KNUCKLE PROTECTOR

(71) Applicant: Boxraw Ltd, Coventry (GB)

(72) Inventor: Benjamin Amanna, Coventry (GB)

(73) Assignee: Boxraw Ltd, Coventry (GB)

( * ) Notice: Subject to any disclaimer, the term of this patent is extended or adjusted under 35 U.S.C. 154(b) by 212 days.

(21) Appl. No.: 17/755,879

(22) PCT Filed: Nov. 12, 2020

(86) PCT No.: PCT/GB2020/052878

§ 371 (c)(1),
(2) Date: May 11, 2022

(87) PCT Pub. No.: WO2021/094757

PCT Pub. Date: May 20, 2021

(65) Prior Publication Data

US 2022/0379191 A1 Dec. 1, 2022

(30) Foreign Application Priority Data

Nov. 12, 2019 (GB) ..... 1916434
Sep. 8, 2020 (GB) ..... 2014081

(51) Int. Cl.
*A63B 71/14* (2006.01)
*A41D 13/08* (2006.01)

(52) U.S. Cl.
CPC ..... *A63B 71/14* (2013.01); *A41D 13/081* (2013.01); *A63B 2209/10* (2013.01); *A63B 2244/102* (2013.01)

(58) Field of Classification Search
CPC . A63B 71/14; A63B 2244/102; A63B 71/145; A41D 13/081
See application file for complete search history.

(56) References Cited

U.S. PATENT DOCUMENTS 2,322,710 A * 6/1943 Eisendrath ..... A41D 13/081 D29/113
4,287,609 A * 9/1981 Amadeo ..... A41D 13/081 2/16
4,809,366 A * 3/1989 Pratt ..... A41D 13/084 D29/113

(Continued)

FOREIGN PATENT DOCUMENTS

AU 2015101825 A4 1/2016
GB 2550628 A * 11/2017 ..... A41D 13/081

(Continued)

OTHER PUBLICATIONS

International Search Report and Written Opinion dated Feb. 26, 2021 (Application No. PCT/GB2020/052878).
GB Search Report dated Nov. 9, 2020 (Application No. 2014081.0).

*Primary Examiner* — Khaled Annis
(74) *Attorney, Agent, or Firm* — Brown & Brown IP Law PLLC

(57) ABSTRACT

A knuckle protector for protecting a user's hand comprises a guard member having a knuckle cover portion, a grip portion and an aperture for receiving a finger of said user's hand therethrough; and one or more securing straps connected to the guard member, the securing strap or all of the securing straps being connected to or being connectable to an end of an elongate hand wrap.

20 Claims, 2 Drawing Sheets

(56) References Cited

U.S. PATENT DOCUMENTS

| | | | | | |
|---|---|---|---|---|---|
| 5,079,776 | A * | 1/1992 | Crawford | A63B 71/141 | 2/167 |
| 5,781,928 | A * | 7/1998 | Avila | A41D 13/081 | 602/22 |
| 5,987,641 | A * | 11/1999 | Walker | A41D 13/088 | 2/161.1 |
| 6,013,044 | A * | 1/2000 | Estwanik | A41D 19/01582 | 602/61 |
| 6,093,165 | A * | 7/2000 | Estwanik | A63B 71/145 | 2/161.7 |
| 6,119,267 | A | 9/2000 | Pozzi | | |
| 6,341,376 | B1 * | 1/2002 | Smerdon, Jr. | A41D 13/082 | 2/161.1 |
| 10,569,153 | B2 * | 2/2020 | Hemara | A63B 71/14 | |
| 11,344,788 | B1 * | 5/2022 | Wittman | A63B 71/145 | |
| 11,465,034 | B2 * | 10/2022 | Sharp | A41F 1/06 | |
| 2013/0227755 | A1 * | 9/2013 | Bisaillon | A63B 71/141 | 2/161.1 |
| 2017/0173442 | A1 * | 6/2017 | Hemara | A63B 71/14 | |
| 2018/0133582 | A1 * | 5/2018 | Sharp | A41D 13/088 | |
| 2019/0380402 | A1 * | 12/2019 | Lombard | A41D 13/087 | |
| 2022/0379191 | A1 * | 12/2022 | Amanna | A63B 71/14 | |
| 2022/0401816 | A1 * | 12/2022 | Wittman | A63B 71/145 | |

FOREIGN PATENT DOCUMENTS

| | | | | |
|---|---|---|---|---|
| WO | 2016/069020 | A1 | 5/2016 | |
| WO | WO-2021094757 | A1 * | 5/2021 | A41D 13/081 |

* cited by examiner

KNUCKLE PROTECTOR

FIELD OF THE INVENTION

The present invention relates to knuckle protectors, particularly, but not exclusively, knuckle protectors for boxing and other martial arts. The present invention also relates to kits including knuckle protectors and to a method of protecting a user's hand using a knuckle protector.

BACKGROUND TO THE INVENTION

The knuckles of boxers and other martial artists are susceptible to damage upon impact. Traditional gloves do not provide enough protection for the knuckles, so boxers use hand wraps under the gloves. The hand wraps comprise a length of bandage or similar fabric or textile which is wrapped over the knuckles, around the hand and around the wrist, a process which is quite time consuming. For additional protection, foam padding is also placed over the knuckles before wrapping. However, the foam padding can slip up the hand as the hand is placed into the glove. The foam padding then fails to protect the knuckles and too much pressure is placed on the top of the hand which is uncomfortable and can lead to further damage to the hand.

In this specification, the terms front, forwardly, back, rearwardly etc., are used in relation to when the knuckle protector is in a fitted condition on a user's hand with the hand held level in front of the user. "Front" is in front of the user and "rear" is behind the user and "downward" means down into the ground.

SUMMARY OF THE INVENTION

A first aspect of the present invention provides a knuckle protector for protecting a user's hand comprising:

- a guard member having a knuckle cover portion, a grip portion and an aperture for receiving a finger of said user's hand therethrough;
- one or more securing straps connected to the guard member, the securing strap or all of the securing straps being connected to or being connectable to an end of an elongate hand wrap.

Preferably the guard member comprises a single elongate aperture sized to receive four finger therethrough. The strap or each of the straps may extend across the aperture in the guard member. In other embodiments the guard member may comprise a plurality of apertures, each aperture sized to receive one or two fingers therethrough.

The securing strap or each of the securing straps preferably extends from the cover portion of the guard member. The securing strap or each of the securing straps may be engaged with the grip portion of the guard member. In particular, in some embodiments the securing strap or each of the securing straps preferably comprises a loop around the grip portion.

The knuckle protector may comprise a plurality of securing straps, the securing straps being of different lengths.

An end of the securing strap or each securing strap is preferably secured to an attachment assembly. This connects all of the securing straps together at or proximate an end of the securing straps. In use a pulling force applied to the attachment assembly will, therefore apply a corresponding pulling force evenly to all of the securing straps to secure or tighten the guard portion onto the user's hand. The attachment assembly preferably comprises an attachment loop for connection to a hand wrap. In some embodiments an elongate hand wrap may be secured to the attachment loop.

In other embodiments the knuckle protector further comprises an elongate hand wrap, and an end of the securing strap or each securing strap is permanently secured to the hand wrap.

The guard member is preferably made from a resiliently deformable material. The resiliently deformable material may be a plastics foam material.

A second aspect of the present invention provides a knuckle protector kit comprising:

- a first knuckle protector comprising a guard member having a knuckle cover portion, a grip portion and an aperture for receiving a finger of said user's hand therethrough, and at least two securing straps connected to the guard member, a first securing strap disposed proximate a first end of the aperture and a second securing strap disposed proximate a second end of the aperture, and the securing straps being connected to or being connectable to an end of an elongate hand wrap; and
- a second knuckle protector comprising a guard member having a knuckle cover portion, a grip portion and an aperture for receiving a finger of said user's hand therethrough, and at least two securing straps connected to the guard member, a first securing strap disposed proximate a first end of the aperture and a second securing strap disposed proximate a second end of the aperture, and the securing straps being connected to or being connectable to an end of an elongate hand wrap,
- wherein, in the first knuckle protector the first strap is longer than the second strap and in the second knuckle protector the second strap is longer than the first strap.

The knuckle protector kit may further comprise a pair of elongate hand wraps.

In preferred embodiments the first knuckle protector comprises an attachment assembly secured to an end of the securing strap or all of the securing straps, the first knuckle protector comprises an attachment assembly secured to an end of the securing strap or all of the securing straps, and a first one of the pair of hand wraps is securable to the attachment assembly of the first knuckle protector and a second one of the pair of hand wraps is securable to the attachment assembly of the second knuckle protector.

Preferably, each of the attachment assemblies comprises an attachment loop, and a first end of each of the elongate hand wraps includes a wrap loop for engagement with a corresponding attachment loop.

A third aspect of the present invention provides a method of protecting a user's knuckles with a knuckle protector, the method comprising:

- inserting a user's fingers through an aperture of a guard member of the knuckle protector so that a knuckle cover portion extends over the user's knuckles and a grip portion is disposed proximate the palm of the user's hand;
- pulling a securing strap or all of the securing straps connected to the guard member in a direction towards the user's wrist;
- wrapping an elongate hand wrap around the user's wrist and hand such that a part of the hand wrap extends over the guard member; and
- securing an end of the hand wrap to secure the guard member and the hand wrap to the user's hand.

In some embodiments the knuckle protector comprises a plurality of securing straps extending over the aperture and the method preferably further comprises inserting the user's fingers through the aperture such that each one of the securing straps extends between a respective two fingers of the user's hand.

The method may further comprise securing an end of the elongate hand wrap to an attachment assembly secured to an end of the securing strap or all of the securing straps.

In some embodiments the attachment assembly comprises an attachment loop and the method preferably comprises threading an end of the elongate hand wrap through the attachment loop to secure the hand wrap to the attachment assembly.

According to the present disclosure, there is provided a knuckle protector for boxing and other martial arts, the knuckle protector including a knuckle protector member, the knuckle protector member defining an elongate finger hole through which, in a fitted condition, four fingers of a user's hand locate therethrough, the knuckle protector member comprising a knuckle protecting part which in a fitted condition is located across the front of the user's knuckles and a gripping part which in the fitted condition is gripped by the user's hand.

Possibly, the knuckle protecting part is formed of a resiliently deformable material. Possibly, the knuckle protecting part is formed integrally with the gripping part and both or all may be formed of the resiliently deformable material. Possibly, the resiliently deformable material is a plastics material, possibly a foam plastics material.

Possibly, the protector includes a securing strap and an attachment. Possibly, the securing strap extends from the gripping part, over the knuckle protecting part to the attachment. Possibly, in the fitted condition, the strap passes from the gripping part, between two of the user's fingers, over the knuckle protecting part to the attachment, which is on the back of the user's hand or wrist.

Possibly, the strap extends around the gripping part in a loop, which, in an unfitted condition may be a loose loop, possibly, to permit a degree of movement of the loop and the strap relative to the gripping part.

Possibly, the strap is fixed at one end to the attachment, and may be fixed at the other end to the gripping part.

Possibly, the other end of the strap is fixed to the knuckle protecting part, or to the strap itself between the gripping part and the attachment.

Possibly, the other end of the strap is fixed to the attachment.

Possibly, the strap includes: an outward length, which extends from the attachment, over the knuckle protecting part, through the finger hole, and around the gripping part; and a return length, which extends back over the knuckle protecting part and back to the attachment.

Possibly, the knuckle protecting part includes a guide, which may define a guide aperture, through which the strap passes. Possibly, the strap is laterally constrained by the guide, but possibly not longitudinally constrained, to permit tightening of the strap between the gripping part and the attachment.

Possibly, in use in the fitted condition, in tightening the strap, the knuckle protecting part is compressed against the user's knuckles.

Possibly, both the outward length and the return length pass through the guide aperture.

Possibly, the protector includes a plurality of straps and may include a corresponding plurality of guide apertures, which may be defined by the guide. Possibly, the protector includes three straps, each of which, in the fitted condition, may locate between different fingers, and the protector may include three guide apertures.

Possibly, the attachment includes a rearwardly extending attachment loop. Possibly, the protector includes an elongate wrap member which locates through the attachment loop. Possibly, the wrap member includes a loop end and a free end.

Possibly, the wrap member includes a wrap loop which extends from the loop end, to secure the wrap member to the attachment loop.

Possibly, in moving to the fitted condition, the wrap loop is located through the attachment loop and the free end of the wrap member may be threaded through the wrap loop. Possibly, in the fitted condition, the wrap member is wrapped several times around the hand, between the thumb and the palm and over the wrist to secure the knuckle protector. Possibly, the wrap member includes a fastener to fasten the free end. The fastener may comprise hook and loop material.

According to the present disclosure, there is provided a method of protecting the knuckles of a boxer or other martial artist, the method including providing a knuckle protector, the knuckle protector including a knuckle protector member, the knuckle protector member defining an elongate finger hole through which, in a fitted condition, four fingers of a user's hand locate therethrough, the knuckle protector member comprising a knuckle protecting part which in a fitted condition is located across the front of the user's knuckles and a gripping part which in the fitted condition is gripped by the user's hand.

Possibly, the knuckle protector includes any of the features described in any of the preceding statements or following description. Possibly, the method includes any of the steps described in any of the preceding statements or following description.

Preferred and/or optional features of each aspect and embodiment described above may also be used, alone or in appropriate combination, in the other aspects and embodiments also.

BRIEF DESCRIPTION OF THE DRAWINGS

The invention will now be further described by way of example only and with reference to the accompanying drawings, in which.

Figure 1:
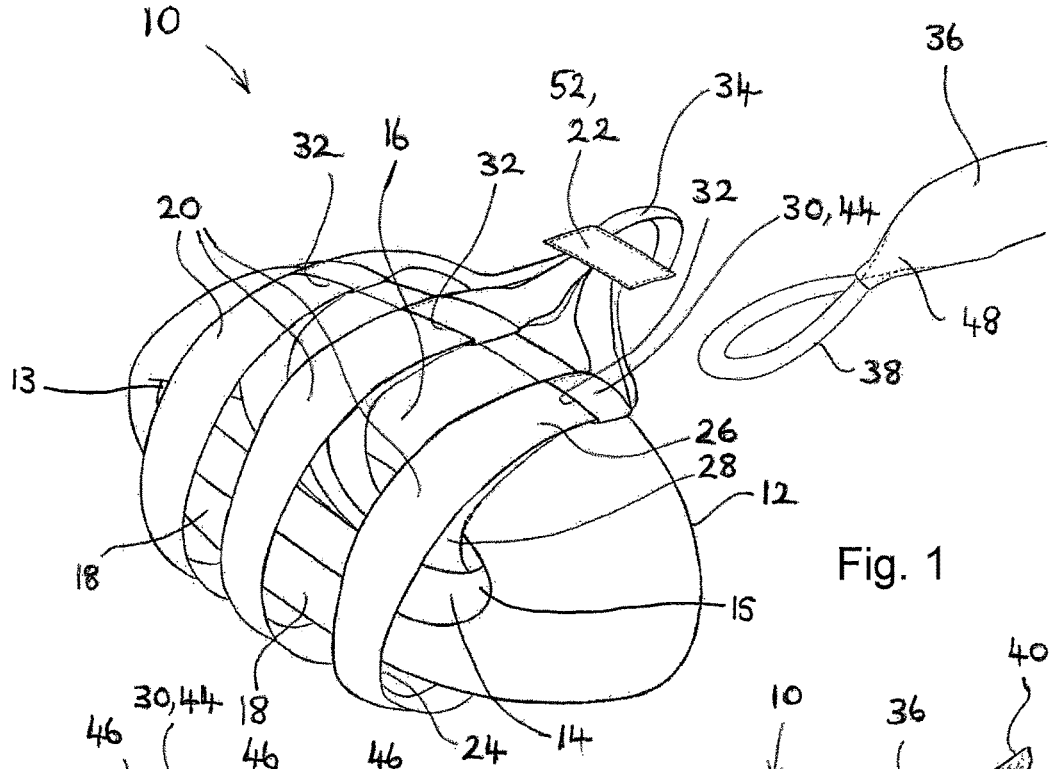
FIG. 1 is a perspective view of a knuckle protector.
Figure 2:
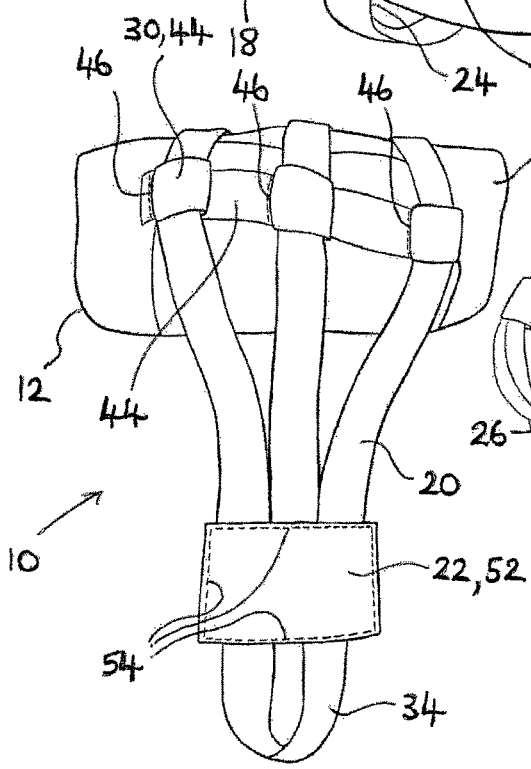
FIG. 2 is a plan view of the knuckle protector.
Figure 3:
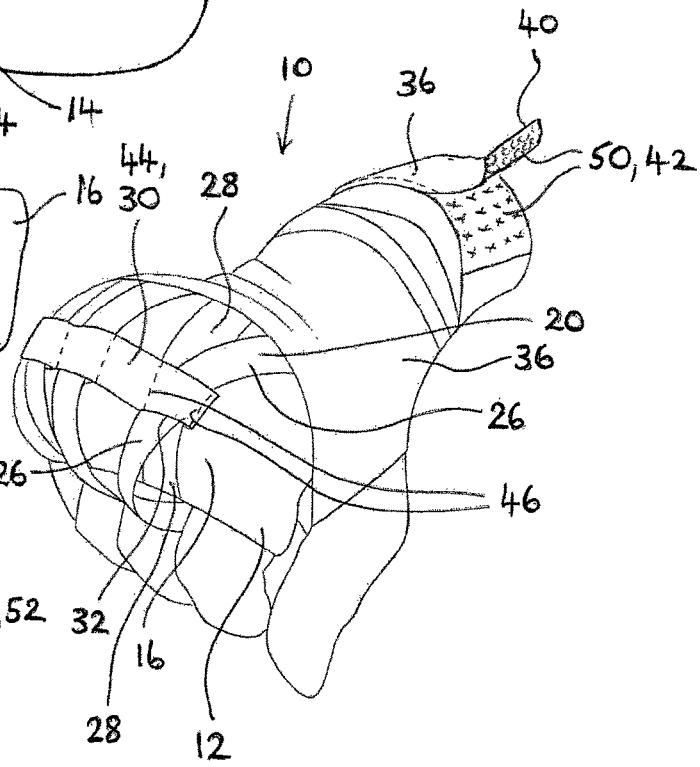
FIG. 3 is a perspective view of the knuckle protector in a fitted condition.
Figures 4, 5, 6, 7, 8:
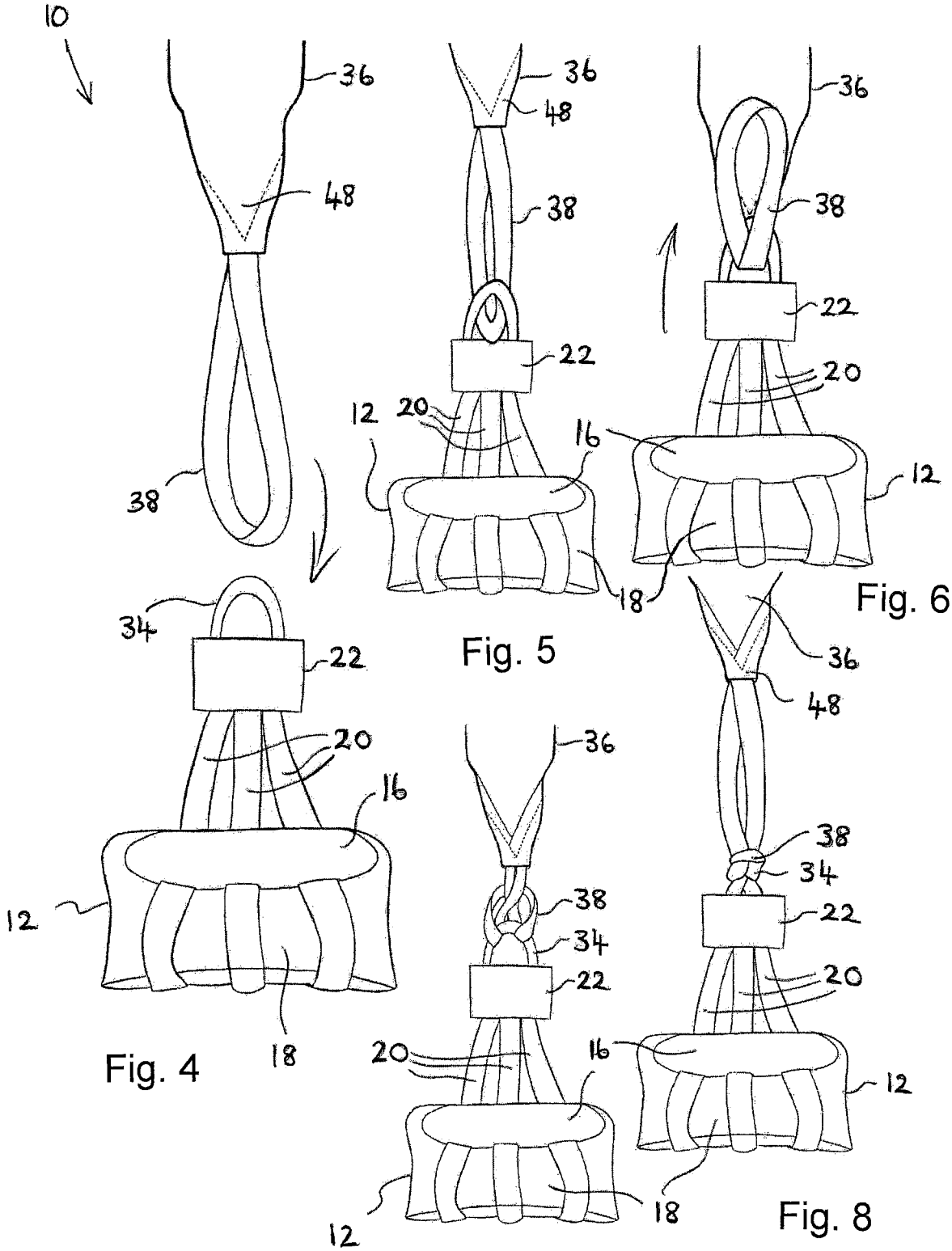
FIGS. 4 to 8 show successive stages in attaching a wrap member to a knuckle protector member.

In the drawings, where multiple instances of the same or similar features exist, only a representative one or some of the instances of the features have been provided with numeric references for clarity.

In the drawings, where necessary, the general locations of features which are hidden (e.g. are behind or inside another feature) are indicated by numeric references with regular dashed leader lines.

DESCRIPTION OF THE PREFERRED EMBODIMENTS

FIG. 1 shows a knuckle protector 10 for boxing and other martial arts. The knuckle protector 10 includes a knuckle protector member or guard member 12. The guard member 12 includes an elongate finger hole or aperture 14 through which, in a fitted condition, four fingers of a user's hand locate. The guard member 12 comprises a knuckle protecting part or cover portion 16 which in a fitted condition is located across the front of the user's knuckles to cover and protect the user's knuckles, and a gripping part or grip portion 18 which in the fitted condition is disposed proximate the user's palm and may be gripped by the user's hand.

In preferred embodiments the guard member 12 is a unitary, one-piece member, and the cover portion 16 and grip portion 18 extend around and define the aperture 14. In the example shown, the knuckle protecting part 16 and the gripping part 18 are formed integrally of a resiliently deformable material. The resiliently deformable material could be a foam plastics material.

The knuckle protector 10 further comprises one or more tightening straps or securing straps 20 that extend from the guard member 12. The knuckle protector 10 further comprises an attachment assembly 22. The attachment assembly 22 is disposed at an end of the securing straps 20 furthest from the guard member 12 and is secured to all of the securing straps 20.

In the example shown, the knuckle protector 10 includes three securing straps 20 connected to a single attachment assembly 22. The three securing straps 20 are spaced apart along a width of the guard member 12, i.e. in a lateral direction that would extend across a user's knuckles when the guard member 12 is worn on a user's hand.

In this embodiment each securing strap 20 includes two ends, both of which are fixed to the attachment assembly 22. Each securing strap 20 includes an outward length 26, which extends from the attachment assembly 22, over the knuckle protecting part 16, across a front of the finger hole 14 and over and around the gripping part 18, and a return length 28, which extends back through the finger hole 14, back over the knuckle protecting part 16 and back to the attachment assembly 22. In this way, each of the straps 20 forms a loop 24 around the gripping part 18.

In an unfitted condition, each strap loop 24 is a loose loop, to permit a degree of movement of the loop 24 and the strap 20 relative to the gripping part 18.

The straps 20 could be formed of fabric or textile materials. The straps 20 could have a resilient property, i.e. have some "stretch", to provide extra tensioning/tightening.

The knuckle protecting part 16 includes a guide 30, which, in the example shown, includes three guide apertures 32. One of the straps 20 extends through a respective one of the guide apertures. In particular, both the outward and return lengths 26, 28 of each one of the straps 20 passes through the respective guide aperture 32. The guide 30 laterally constrains each of the straps 20, but does not constrain the straps 20 longitudinally. This allows some lateral or sideways movement of each of the straps 20 relative to the finger hole 14, and in particular allows lateral movement of the loops 24.

The extension of the straps 20 across and through the finger hole 14 effectively divides the finger hole 14 into a plurality of apertures. In use a single finger is inserted through each of the apertures such that a part of each of the straps 20 extends between adjacent fingers. In this example, in which there are three straps 20, the positioning of the straps relative to the finger hole 14 defines four apertures. In use, a user's index finger is disposed between a first end 13 of the finger hole 14 and a first strap 20*a*, a user's middle finger is disposed between the first strap 20*a* and a second strap 20*b*, a user's ring finger is disposed between the second strap 20*b* and a third strap 20*c*, and a user's little finger is disposed between the third strap 20*c* and a second end 15 of the finger hole 14.

In this example the guide 30 comprises a guide member 44, which could be an elongate strip of a fabric material, which is fastened to the knuckle protecting part 16 by intermittent fastenings 46, which could be, for example, stitching and/or gluing.

The attachment assembly 22 includes a rearwardly extending attachment loop 34. The knuckle protector 10 preferably includes an elongate wrap member 36 which locates through the attachment loop 34. The wrap member 36 includes a loop end 48 and a free end 40. The wrap member 36 includes a wrap loop 38 which extends from the loop end 48 to secure the wrap member 36 to the attachment loop 34 as will be described below. The wrap member 36 includes a fastener 42 to fasten the free end 40. The fastener 42 could comprise areas of hook and fleece material or hook and loop material 50 which are located on opposite sides of the wrap member 36 at or towards the free end 40 and which in the fitted condition fasten together.

The attachment assembly 22 includes an attachment member 52 which could be formed of a fabric or textile material, to which the straps 20 and the attachment loop 34 are fixed by attachment fastenings 54, which could comprise stitching and/or gluing.

In one example, an end portion of two of the strap lengths 26, 28 may extend past the attachment member 52 to form the attachment loop 34. This provides a good transfer of force during tightening from the attachment loop 34 to the knuckle protector member 12.

In this embodiment the shape of the knuckle protector member 12 is rounded on all of the external surfaces and from the front is oval. The finger hole 14 is oval in shape from the front. The width of the gripping part 18 is reduced relative to the width of the knuckle protecting part 16.

Importantly, the knuckle protector 10 and its components are formed of relatively soft and flexible materials such as cloth, fabric, foam plastic and textile, rather than relatively hard and rigid materials such as metal and hard plastics. The use of relatively soft and flexible materials reduces the risk of damage to the user in use.

In Use

In moving to the fitted condition, the user inserts his/her fingers through the finger hole 14, with each of the straps 20 located between different fingers, as described above. The knuckle protecting part 16 is located across the front of the user's knuckles to cover the knuckles and the gripping part 18 is disposed proximate the user's palm to be gripped within the user's hand.

The attachment loop 34 is then pulled rearwardly to tighten the straps 20 and compress the knuckle protecting part 16 against the user's knuckles. Advantageously, the straps 20 are free to move around the gripping part 18 and lengthwise through the guide apertures 32 to permit a good fit to be achieved.

Referring to FIGS. 4 to 8, the wrap loop 38 is located through the attachment loop 34 and the free end 40 of the wrap member 36 is threaded through the wrap loop 38. The wrap member 36 may then be pulled and tightened to secure the wrap member 36 to the attachment loop 34. The wrap member 36 is then wrapped several times around the hand, between the thumb and the palm and over the wrist to secure the knuckle protector 10 to the user's hand. It will be appreciated that the wrap member 36 may be wrapped around the user's hand and wrist in a manner known in the art. Finally, the hook and fleece areas 50 of the wrap member 36 are fastened together. The user can then don a boxing glove (not shown) over the hand and the knuckle protector 10.

Advantageously, the knuckle protector 10 is easy and quick to fit, and is securely held in place so that the knuckle protecting part 16 cannot be dislodged during fitting of the glove or in use. In particular, the combination of the gripping part 18 with the knuckle protecting part 16 and the straps 20 stops the knuckle protecting part 16 from sliding back over the user's knuckles and along the back of the user's hand. The knuckle protector member provides good protection for the user's knuckles and the back of the hand. The straps compress the knuckle protecting part against the knuckles to provide extra protection. The degree of compression can be determined by the user by tightening or loosening the straps as required. The straps separate the fingers which is important to avoid finger damage.

The direct connection of an end of the wrap member 36 to the attachment loop 34 means that the position of the guard member 12 relative to the wrap member 36 will not change during wrapping of the wrap member 36. Furthermore, as the wrap member 36 is pulled tightly around a user's hand this will continue to apply a force to the securing straps 20 to pull the guard member 12 firmly into engagement with the user's fingers.

Other Modifications

Various other modifications could be made without departing from the scope of the invention. The knuckle protector and the various components thereof could be of any suitable size and shape, and could be formed of any suitable material (within the scope of the specific definitions herein).

The knuckle protector 10 could be a different shape to that shown. The guard member 12 may include a single finger hole or aperture 14 as described above, or the guard member may comprise two, three or four apertures. Each of the apertures 14 may be sized to receive one or more finger therethrough. For example, in one embodiment, the guard member may include two apertures, each aperture being sized to receive two finger therethrough. The knuckle protector 10 may comprise two securing straps, each one of the securing straps being associated with one of the two apertures, such that a strap loop 24 is formed through each of the apertures. Accordingly, when a user inserts two finger through an aperture, the respective strap will extend between and separate those two fingers.

The knuckle protector 10 could therefore include different numbers of straps 20. In one example, the knuckle protector 10 could include only one strap 20.

The straps 20 could be fixed differently. In one example, one end of each strap 20 is fixed to the gripping part 18 and extends from the gripping part 18, over the knuckle protecting part 16 to the attachment assembly 22. In another example, the one end is fixed to the knuckle protecting part 16, or to a region of the strap 20 itself between the gripping part 18 and the attachment assembly 22.

In some embodiments the securing straps 20 may be of different lengths. In particular a length of each securing strap 20 between the knuckle protecting part 16 and the attachment assembly 22 may be different. In a preferred embodiment the knuckle protector 10 includes three securing straps 20; a first outer strap, a central strap and a second outer strap, the outer straps being disposed either side of the central strap. Preferably, the first outer strap is longest, the central strap is shorter than the first outer strap, and the second outer strap is shorter than the central strap. In use, the first outer strap extends between the ring finger and little finger of the user, such that the attachment assembly is disposed to a side of the user's wrist nearest the thumb. In this way, a left-handed knuckle protector and a right-handed knuckle protector may be provided. In the left-handed version the first outer strap may be disposed proximate a first end of the finger hole and the second outer strap may be disposed proximate a second end of the finger hole, and in the right-handed version the first outer strap may be disposed proximate the second end of the finger hole and the second outer strap may be disposed proximate the first end of the finger hole.

The wrap member 36 could be different and could be attached to the straps 20 differently. In one example, the wrap member 36 is permanently attached to the straps 20. The wrap member 36 could be formed of any suitable material. In preferred embodiments a first end of the wrap member 36 is secured to the attachment assembly 22 or directly to the securing straps 20.

The connection of the straps 20 to the wrap member 36 could be different. The wrap member 36 may be integrally formed with the securing straps 20. In this way, the securing straps 20 may be an extension of the wrap member 36.

In one example, the knuckle protecting part 16 and the gripping part 18 could be formed separately, possibly of different materials and then fixed or fastened together, permanently or releasably. The gripping part 18 and/or the knuckle protecting part 16 could be formed of a gel-filled material. The gripping part 18 could include a material to improve grip and/or absorb sweat, which could comprise any from the group containing: terry toweling, moisture wicking material, moisture wicking coating.

There is thus provided a knuckle protector with a number of advantages over conventional arrangements. In particular, the knuckle protector of the invention is easy and quick to fit and secure when fitted. The knuckle protector member provides good protection for the user's knuckles. The straps compress the knuckle protecting part against the knuckles to provide extra protection.

Any of the features or steps of any of the embodiments shown or described could be combined in any suitable way, within the scope of the overall disclosure of this document.

Other modifications and variations not explicitly disclosed above may also be contemplated without departing from the scope of the invention as defined in the appended claims.

The invention claimed is:

1. A knuckle protector for protecting a user's hand comprising:

a unitary guard member having a knuckle cover portion configured to locate across a front of a user's knuckles, a grip portion configured to locate proximate the user's palm, and an aperture for receiving a plurality of fingers of said user's hand therethrough;

a plurality of securing straps connected to the guard member and extending over the knuckle cover portion, each of the securing straps extending from the guard member;

a guide of the knuckle cover portion arranged to constrain lateral movement of the securing straps;

an attachment assembly disposed at an end of the securing straps furthest from the guard member, the attachment assembly being attached to all of the securing straps and comprising a rearwardly extending attachment loop for securing to an elongate hand wrap, wherein the straps are arranged such that, in use, rearward movement of the attachment loop causes the straps to tighten and compress the knuckle cover portion against a user's knuckles.

2. The knuckle protector according to claim 1, wherein the guard member comprises a single elongate aperture sized for receiving four fingers therethrough.

3. The knuckle protector according to claim 1, wherein each of the straps extends across the aperture in the guard member.

4. The knuckle protector according to claim 1, wherein the guard member comprises two or three apertures, at least one of said apertures sized for receiving two fingers therethrough.

5. The knuckle protector according to claim 1, wherein each of the securing straps is engaged with the grip portion of the guard member.

6. The knuckle protector according to claim 5, wherein each of the securing straps comprises a loop around the grip portion.

7. The knuckle protector according to claim 1 in which the securing straps are of different lengths.

8. The knuckle protector according to claim 1, further comprising an elongate hand wrap secured to the attachment loop.

9. The knuckle protector according to claim 1, wherein the guard member is made from a resiliently deformable material.

10. The knuckle protector according to claim 1, wherein the straps are resilient or stretchable.

11. The knuckle protector according to claim 1, in which the guide comprises a guide member fastened to the knuckle cover portion to provide guide apertures, each of the securing straps extending through a respective one of the guide apertures.

12. The knuckle protector according to claim 1, in which each securing strap includes two ends, both of which are fixed to the attachment assembly, and each securing strap includes:

an outward length, which extends from the attachment assembly, over the knuckle cover portion, across a front of the aperture of the guard portion and over and around the grip portion; and a return length, which extends back through the aperture of the guard portion, back over the knuckle cover portion and back to the attachment assembly, such that each of the securing straps forms a loop around the grip portion.

13. A knuckle protector kit comprising a first knuckle p for and a second knuckle protector, the first knuckle protect comprising:

a unitary first protector guard member having a first protector knuckle cover portion configured to locate across a front of a user's knuckles, a fire protector grip portion configured to locate proximate the user's palm, and a first protector aperture for receiving a plurality of fingers of said user's hand therethrough;

a plurality of first protector securing straps connected to the first protector guard member and extending over the first protector knuckle cover portion, each of the first protector securing straps extending from the first protector guard member;

a first protector guide of the first protector knuckle cover portion arranged to constrain lateral movement of the first protector securing straps;

a first protector attachment assembly disposed at an end of the first protector securing straps furthest from the first protector guard member, the first protector attachment assembly and bring attached to all of the first protector securing straps and comprising a rearwardly extending first protector attachment loop for securing to a first protector elongate hand wrap, wherein the first protector securing straps are arranged such that, in use, rearward movement of the first protector attachment loop causes the first protector securing straps to tighten and compress the first protector knuckle cover portion against a user's knuckles, the second knuckle protector comprising:

a unitary second protector guard member having a second protector knuckle cover portion configured to locate across a front of a user's knuckles, a second protector grip portion configured to locate proximate the user's palm, and a second protector aperture for receiving a plurality of fingers of said user's hand therethrough;

a plurality of second protector securing straps connected to the second protector guard member and extending over the second protector knuckle cover portion, each of the second protector securing straps extending from the second protector guard member;

a second protector guide of the second protector knuckle cover portion arranged to constrain lateral movement of the second protector securing straps;

a second protector attachment assembly disposed at an end of the second protector securing straps furthest from the second protector guard member, the second protector attachment assembly being attached to all of the second protector securing straps and comprising a rearwardly extending second protector attachment loop for securing to a second protector elongate hand wrap, wherein the second protector securing straps are arranged such that, in use, rearward movement of second protector attachment loop causes the second protector securing straps to tighten and compress the second protector knuckle cover portion against a user's knuckles, a first one of the first protector securing straps is disposed proximate a first end of the protector aperture and a second one of the first protector securing straps is disposed proximate a second end of the first protector aperture;

a first one of the first protector securing straps is disposed proximate a first end of the first protector aperture and a second one of the first protector securing straps is disposed proximate a second end of the first protector aperture;

a first one of the second protector securing straps is disposed proximate a first end of the second protector aperture and a second one of the second protector securing straps in disposed proximate a second end of the second protector aperture, wherein the first securing strap of the first knuckle protector is longer than the second securing strap of the first knuckle protector, and the second securing strap of the second knuckle protector is longer than the first securing strap of the second knuckle protector, so that the first knuckle protector forms a left-handed knuckle protector and the second knuckle protector forms a right-handed knuckle protector.

14. The knuckle protector kit according to claim 13, further comprising a pair of elongate hand wraps.

15. The knuckle protector kit according to claim 14, wherein a first one of the pair of hand wraps is secured to the first protector attachment assembly, and a second one of the pair of hand wraps is secured to the second protector attachment assembly.

16. The knuckle protector kit according to claim 15, wherein a first end of each of the elongate hand wraps includes a wrap loop for engagement with either of the first protector attachment loop or the second protector attachment loop.

17. A method of protecting a user's knuckles, the method comprising:

inserting a user's fingers through an aperture of unitary guard member of a knuckle protector, the knuckle protector comprising the unitary guard member, a plurality of securing straps, a guide of the knuckle cover portion and an attachment assembly, the unitary guard member having a knuckle cover portion configured to locate across a front of the user's knuckles, a grip portion configured to locate proximate the user's palm, and the aperture, so that the knuckle cover portion extends over and across a front of the user's knuckles and the grip portion is disposed proximate the palm of the user's hand, a plurality of securing straps connected to the guard member and extending over the knuckle cover portion, each of the securing straps extending from the guard member, a guide of the knuckle cover portion arranged to constrain lateral movement of the securing straps, an attachment assembly disposed at an end of the securing straps furthest from the guard member, the attachment assembly being attached to all of the securing straps and comprising a rearwardly extending attachment loop for securing to an old elongate band wrap, the securing straps configured such that rearward movement of the attachment loop causes the securing straps to tighten and compress the knuckle cover portion against a user's knuckles;

pulling the attachment assembly rearwardly in a direction towards the user's wrist so that the securing straps tighten and compress the knuckle cover portion against the user's knuckles;

wrapping an elongate hand wrap secured to the attachment loop around the user's wrist and hand such that a part of the hand wrap extends over the guard member; and securing an end of the hand wrap to secure the guard member and the hand wrap to the user's hand.

18. The method according to claim 17, further comprising inserting the user's fingers through the aperture such that each one of the securing straps extends between a respective two fingers of the user's hand.

19. The method according to claim 17, further comprising securing the end of the elongate hand wrap to the attachment loop before wrapping the hand wrap around the user's wrist.

20. The method according to claim 19, further comprising threading an end of the elongate hand wrap through the attachment loop to secure the hand wrap to the attachment assembly.

* * * * *